US005438857A

United States Patent [19]

Kleinhaeny

[11] Patent Number: 5,438,857

[45] Date of Patent: Aug. 8, 1995

[54] LOCK CYLINDER AND KEY AS WELL AS KEY BLANK WITH MATCHED SECURITY DEVICE

[75] Inventor: Arno Kleinhaeny, Hinwil, Switzerland

[73] Assignee: Bauer Kaba AG, Wetzikon, Switzerland

[21] Appl. No.: 200,803

[22] Filed: Feb. 14, 1994

Related U.S. Application Data

[63] Continuation of Ser. No. 942,365, Sep. 9, 1992, abandoned, which is a continuation of Ser. No. 618,231, Nov. 20, 1990, abandoned.

[30] Foreign Application Priority Data

Dec. 15, 1989 [CH] Switzerland ..... 04517/89

[51] Int. Cl.[6] ..... E05B 27/10

[52] U.S. Cl. ..... 70/493; 70/406; 70/409; 70/421

[58] Field of Search ..... 70/406, 409, 493, 390, 70/405, 407, 421, 423, 427

[56] References Cited

U.S. PATENT DOCUMENTS

| | | | |
|---|---|---|---|
| 18,169 | 9/1857 | Yale | 70/406 |
| 1,438,336 | 12/1922 | Schroeder | 70/406 |
| 3,393,542 | 7/1968 | Crepinsek | 70/406 |
| 3,656,328 | 4/1972 | Hughes | 70/358 X |
| 3,742,744 | 7/1973 | Lumme | 70/421 X |
| 4,098,104 | 7/1978 | Wolter | 70/406 |
| 4,213,316 | 7/1980 | Tietz | 70/35 |
| 4,289,002 | 9/1981 | Gretler | 70/358 |
| 4,612,787 | 9/1986 | Prunbauer et al. | 70/409 X |
| 4,964,288 | 10/1990 | Braun et al. | 70/409 X |
| 4,977,767 | 12/1990 | Prunbauer | 70/409 X |

FOREIGN PATENT DOCUMENTS

| | | | |
|---|---|---|---|
| 0202949 | 11/1986 | European Pat. Off. . | |
| 2535376 | 5/1984 | France . | |
| 2551794 | 3/1985 | France | 70/493 |
| 2003059 | 7/1971 | Germany | 70/493 |
| 3225952 | 1/1984 | Germany | 70/405 |
| 3314511A1 | 10/1984 | Germany . | |
| 7317470 | 3/1975 | Netherlands | 70/409 |
| 3184/88 | 8/1988 | Switzerland . | |

*Primary Examiner*—Lloyd A. Gall
*Attorney, Agent, or Firm*—Walter C. Farley

[57] ABSTRACT

A lock cylinder with key, in which the cylinder has a rotor and a stator with radial tumbler pins and the key has depressions corresponding to the tumbler pins. At least one tumbler pin functions as a control pin (K), in that a zone produced by an offset provides a side coding (F) in addition to the depth coding (T) with a diameter corresponding to an additional coding (B) and the associated key has a depression with sides (8), whose spacing between the sides corresponds to the coded diameter (B) of the control pin offset and whose tumbler pin cooperates on the one hand with the milled coding in the key and on the other hand with control faces formed in the key blank. The aim is to create a copying or forging obstacle by means of a technical measure in the cylinder and on the blank.

9 Claims, 8 Drawing Sheets

FIG. 13A
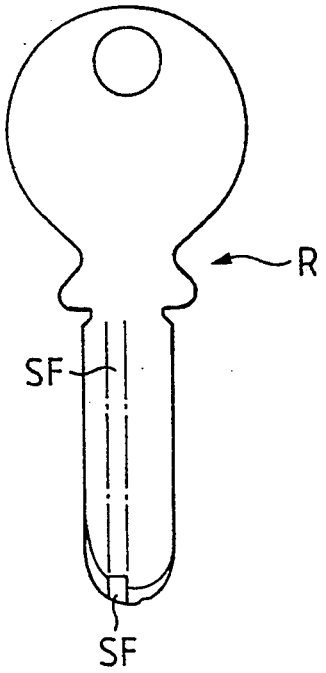
FIG. 13B
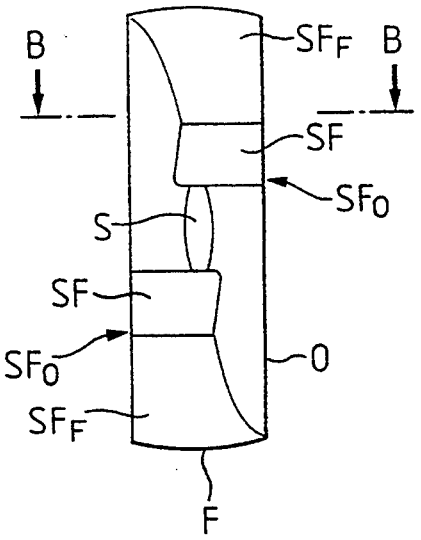
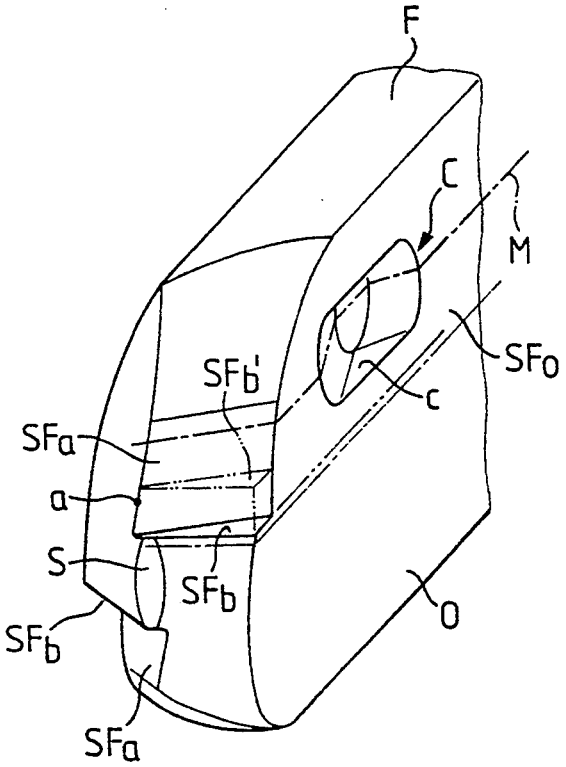
FIG. 13D
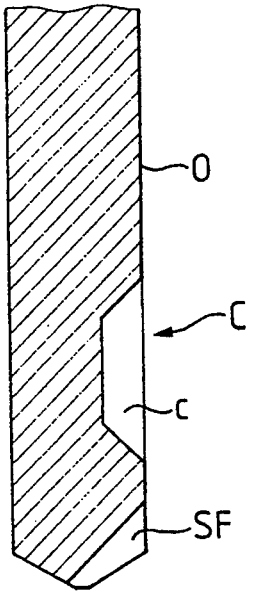
FIG. 13C

FIG. 14A
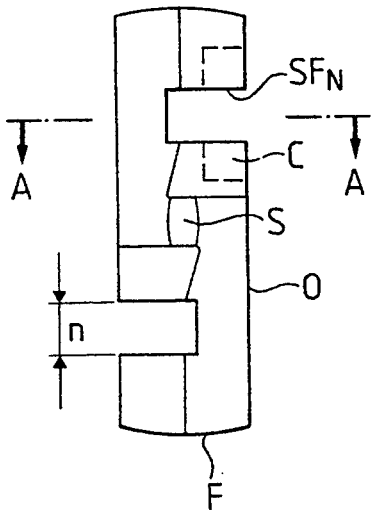
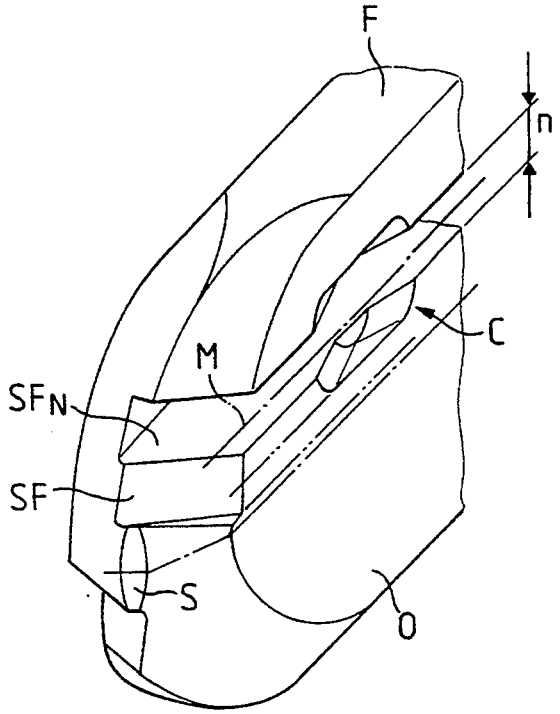
FIG. 14C
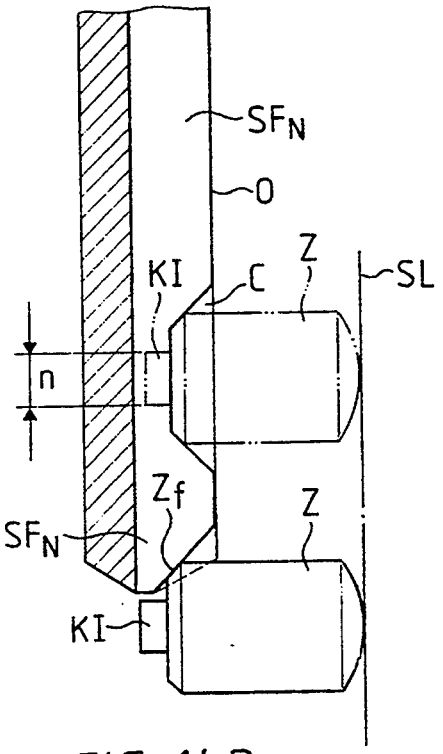
FIG. 14B

FIG. 15A
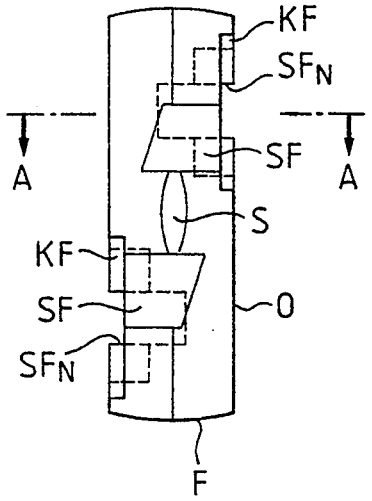
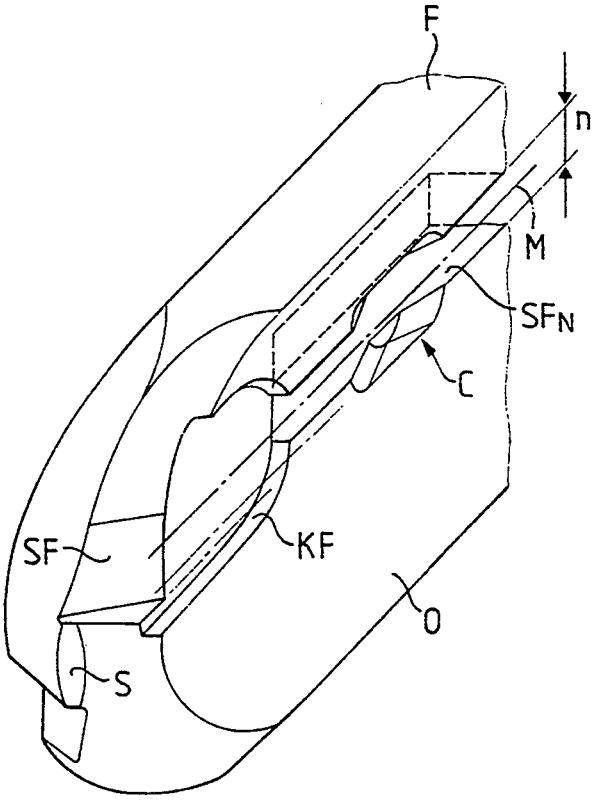
FIG. 15C
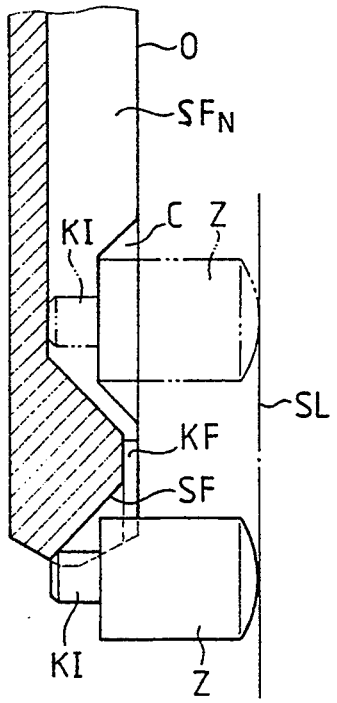
FIG. 15B

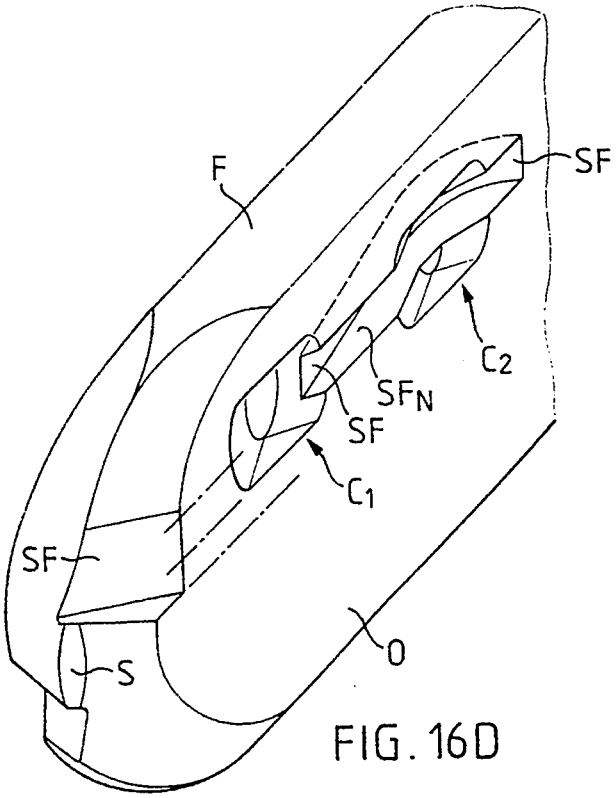
FIG. 16D
FIG. 16A
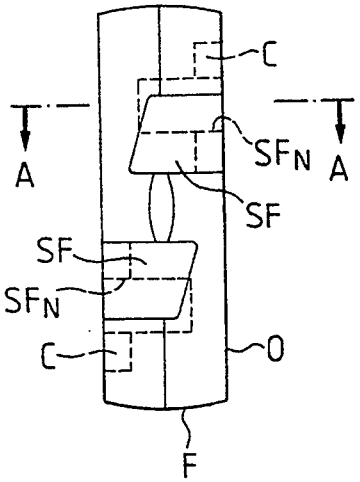
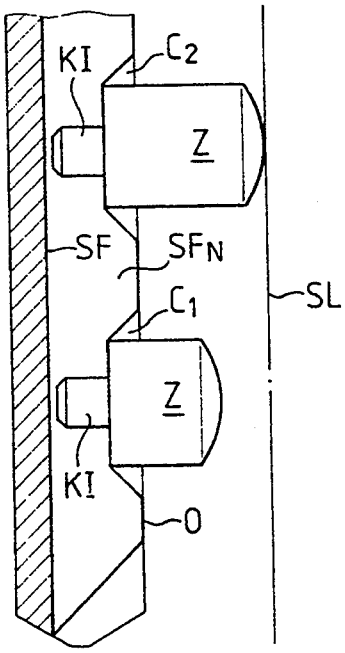
FIG. 16B
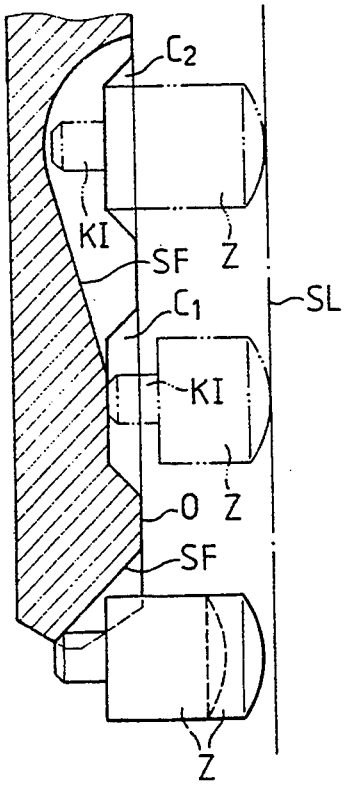
FIG. 16C

LOCK CYLINDER AND KEY AS WELL AS KEY BLANK WITH MATCHED SECURITY DEVICE

CROSS-REFERENCE TO RELATED APPLICATION

This is a continuation of Ser. No. 07/942,365 filed Sep. 9, 1992, now abandoned, which was a continuation of Ser. No. 07/618,231 filed Nov. 20, 1990, now abandoned.

FIELD OF THE INVENTION

The invention is in the field of security technology and relates to a security device which, in interplay with a lock cylinder and its key or key blank makes unauthorized copying or forging of keys more difficult.

BACKGROUND OF THE INVENTION

Legal protective measures making the copying of keys illegal and practical protective measures making copying very difficult are used against the forging of keys. With respect to the practical measures, a distinction can be made between those bringing about concealment or secrecy and those which make manufacture difficult. In the latter case the manufacture is made so difficult as a result of the mechanical conditions, that only appropriately equipped key copiers or forgers can carry out manufacture. Combinations of these are used in order to provide a practical protection.

SUMMARY OF THE INVENTION

An object of the present invention is to provide a structural measure in the lock cylinder and on the key, which not only make the manufacture of key copies, but also a matching key blank more difficult.

Briefly described, the invention comprises a lock cylinder with key, in which the cylinder has a rotor and a stator with radial tumbler pins and the key has depressions corresponding to the tumbler pins. At least one tumbler pin functions as a control pin (K), that by means of a zone can perform a side coding (F) in addition to the depth coding (T). The control pin is guided on insertion by control faces ($SF,SF_N$) on the blank of an associated key (S), the control pin being located to reach the control faces, the .associated key having at least one control face corresponding with the control pin (K). Control surfaces are formed on the blank before and independently of any coding depressions.

BRIEF DESCRIPTION OF THE DRAWINGS

The invention is described in greater detail hereinafter relative to a non-limitative embodiment and the attached drawings, wherein:

FIG. 13A is a plan view of a key blank constructed so that the control faces for one or more control pins are provided at the tip for entry of the key blade.

FIGS. 13B, 13C and 13D are end elevation, longitudinal sectional and perspective views, respectively of an embodiment of a key blank constructed in such a way that the control faces for one or more control pins at the tip enter on to the key blade and extend over a code depression;

FIGS. 14A, 14B and 14C are end elevation, longitudinal sectional and perspective views, respectively of a second key blank constructed in such a way that the control faces for one or more control pins extend over the key blade and pass through the code depressions;

FIGS. 15A, 15B and 15C are end elevation, longitudinal sectional and perspective views, respectively of a third key blank constructed in such a way that the control faces for several control pins extend over the key blade and simultaneously two control pins sense the control faces at different points; and FIGS. 16A, 16B, 16C and 16D are end elevation, longitudinal sectional and perspective views, respectively of a fourth key blank based on the embodiment of FIG. 15.

DESCRIPTION OF THE PREFERRED EMBODIMENT

Figure 1:
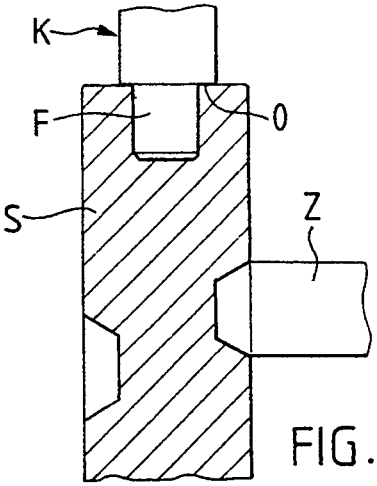
FIG. 1 is a partial transverse sectional view of a key S with a depression for a control pin in the narrow side and a conventional tumbler pin on the flat side.

The aim is that no longer will just any key blank be usable, because the security devices in the lock cylinder now only cooperate with specific key blanks. As a result of this measure the copying process using a copying machine is made more difficult and it is necessary to use a particular blank, which cannot be readily acquired. The forging of a key from a blank which "fits" with regards to the key channel is no longer possible, because the blank cooperating with the security devices has special control faces provided at the time of its manufacture and which only cooperate with specific control pins. In conjunction with the security devices in the lock cylinder reference is made to U.S. patent application Ser. No. 07/598,769.

The presently used copy milling process requires for the production of a skeleton key a cutting stylus or cutter, with which are cut the depressions of the "hole pattern"in the following or scanning process.

With the cutting stylus, i.e. a milling cutter, the depressions are made in the blank in the manner in which they are followed by the copying machine detector on the key to be copied. In the case of most locking systems, it is merely a question of the key having a depression with a depth which allows the tumbler pin to sink to opening position. Thus, by means of a single cutting stylus different key brands can be copied, which offers the major advantage for the manufacturer of key copies that he does not have to reset and adjust the copying machine for Each individual key brand. This also makes it possible for him to produce high-quality key copies with relatively unqualified personnel. A non-standard key could only be copied with high expenditure, because the resetting and adjustment would not be worthwhile for a few or even a single key. It is therefore clear that keys with such a security feature would offer more practical protection against unauthorized forging than keys without this measure.

In accordance with the invention, this measure consists of the construction of one or more additional and/or existing tumbler pins to form control pins controlling a further code corresponding to a key depression which cannot be readily simulated by the detector/cutting stylus, as well as in the construction of control faces on the key blank which cooperate with the control pins and which do not have to be made in connection with the coding milling and can instead be provided during the manufacture of the blank and are present in the key blank.

With respect to the construction of such depressions corresponding with control pins reference is made to the Applicant's earlier patented process disclosed in U.S. Pat. No. 4,289,002.

Either the copying detector must not be able to follow the depression in the manner in which it would be necessary for forging, or the cutting stylus must not be able to produce the depression in the way necessary for a completely satisfactory operation. The minimum prerequisite must be an adaptation of the copying machine to the new circumstances.

In the case of the proposed constructional measure it is no longer the depth-following, but instead a side or width following of the depression which is decisive. Side following or scanning means the following of the distance between two facing sides of a depression. For such side following not only the depth, but also the width of a depression is decisive. The tumbler pin performing the side sensing (in order to differentiate it from a tumbler pin Z not controlling the spacing of the sides and hereinafter called control pin K) must dimensionally correspond to a conventional tumbler pin and must in the vicinity of the shear line have the necessary shear resistance or diameter. The side coding is obtained by an offset on the tumbler pin, which gives a diameter-variable, coded following or scanning area. Thus, a two-dimensional coding is obtained, namely the depth steps $T_0$, $T_1$, $T_2$, $T_3$ etc., in conjunction with the side steps $F_0$, $F_1$, $F_2$, etc., which is very sensitive to the previously used "volume milling", with which a depression is made with a cutting stylus of random diameter and was extended in the blank until matching finally occurred with respect to the height steps. A tumbler pin which is only unidimensionally coded will, when carefully guided from its own bore, sink into the unmatching depression and at the correct depth will release the shear line. However, with a two-dimensional coding the correct setting in the direction of the tumbler displacement, i.e. the one dimension in such a way that the shear line could be released, will no longer be successful unless simultaneous matching exists with respect to the side spacing, i.e. the other dimension. The control pins cooperate with special control faces on the key, which have no direct association with the key coding, but which are only associated with the control pin function. This means that a key cannot be inserted into a key channel of a cylinder with control pins without control faces cooperating with the latter, even if it has the correct opening code. The key blank must have these control surfaces, which can be thought of as admission test control surfaces, before the key can be milled. If a different "fitting" blank is used, the key still does not function despite the correct code milling.

Thus, by means of this constructional measure, namely the introduction of a control pin with the code milling to be made on the key blank and with control faces already existing on the blank and produced in a completely different operation, it is possible to achieve the aforementioned effect of making-copying more difficult. The code or coding milling for producing the key can e.g. penetrate such control surfaces, so that the tumbler pins with or without a control pin follow the code depressions in the usual way and the control pin, which simultaneously controls the control faces, operates independently of the code.

For the poorly qualified key copier, who expects his machine to have a constant copying capacity, a key somewhere provided with a depression for one or more control pins represents a considerable obstacle in two respects, namely the detection of such a depression and the carrying out of the correct measures for obtaining a functioning copy. This namely involves the resetting and adjustment of his machine, generally for only a single key and which must not be more expensive than any other not requiring these additional measures. In addition, all his efforts are in vain if the key produced does not have the original control faces.

For the lawful copier or key manufacturer, who has already manufactured the original key from a key blank with the associated control faces and who always has ready the necessary copying measures (e.g. a copying plant allowing a multiple run in the same operation) and who, from the organizational standpoint, can spread the extra costs over a large number of keys to be copied, this measure providing the user with additional security does not represent an additional cost factor.

Subsequently a discussion will take place of the measure of the control pin in conjunction with a tumbler and its depression of the lock cylinder (FIGS. 1 to 10) and subsequently the measure of the control pin in conjunction with the control faces of the key blank (FIGS. 11 to 14).

FIG. 1 diagrammatically shows a key S, in whose narrow side there is a depression of a control pin K and in whose wide side there is a depression for a tumbler pin Z. In each of these two depressions is shown an associated pin. For the control pin the area of the two-dimensional coding is shown as a side coding with the letter F. As will be shown hereinafter, depressions for one or more control pins K can also be provided on the wide side. It is naturally also possible to choose mixed forms, where control pins are located on the narrow and wide sides, the key blank then having corresponding control faces.

Figure 2:
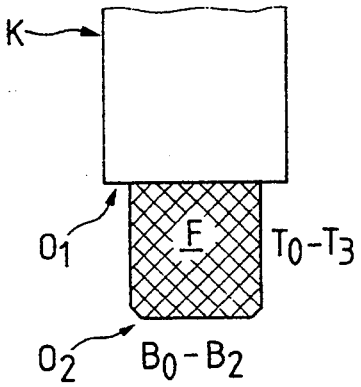
FIG. 2 is a side elevation of a typical control pin K with a side or flank coding F, in which the pin diameter and length and also the contact or mounting faces $O_1$ and $0_2$ are used for coding purposes.

These different parameters of a control pin are shown in FIG. 2. These parameters are the steps in the width of the pin, namely $B_0$–$B_2$ (three steps for side following), the steps in the length of the pin, namely $T_O$–$T_3$ (four steps for the depth following) and the two contact faces $0_1$ and $0_2$, which can be arranged in a random manner relative to the depth steps, either the end face or the offset face constituting the reference face for the depth following process. Thus, the 24 possibilities of a single pin can be successfully concealed.

Figure 3:
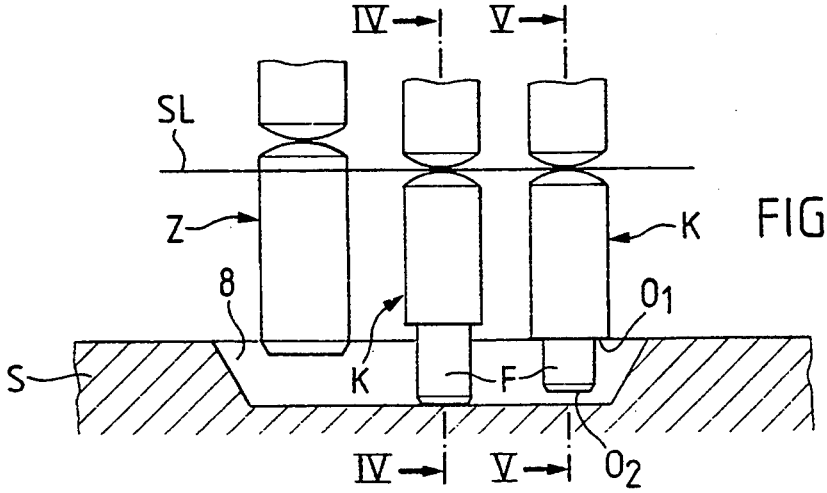
FIG. 3 is a partial longitudinal section of a key having a depression for a control pin showing in exemplified manner one control pin on the contact face $0_1$ and another control pin on the contact face $0_2$, the third pin being a conventional tumbler pin and which is not affected by this constructional measure.

FIG. 3 shows this concealment possibility on a longitudinal depression, in which there are three pins blocking or freeing a shear line SL. The longitudinal depression is side-coded, i.e. is somewhat narrower than the normal depression, as used on standard keys. From left to right it is possible to see a normal tumbler pin Z which, as a result of its larger diameter cannot sink into the depression and consequently keeps the shear line SL blocked, but slides over such a side-coded depression in the same way as if it was not there. The further control pin K is both depth and length-coded with respect to the contact face $0_2$, is located on the bottom of the depression and for correct length and thickness frees the shear line SL, so that an opening turn is possible. The control pin to the far right is also depth and length-coded relative to the contact face 01, is not placed on the bottom of the depression and is instead located on the contact face $0_1$, which is in turn depth-coded. Here again the control pin frees the shear line. This gives a 1:1 concealment of the depth code and on reading out the cylinder it is not possible to establish which of the two contact faces is the reference face for the depth code.

Figure 4:
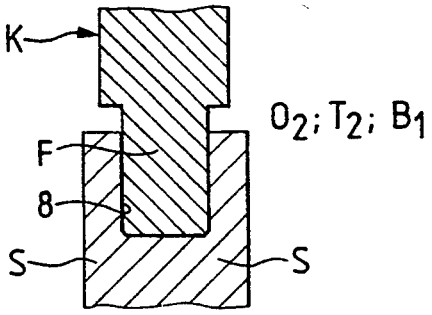
FIG. 4 is a transverse sectional view along line IV—IV of FIG. 3.
Figure 5:
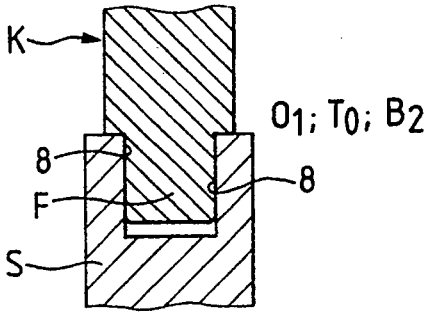
FIG. 5 is a transverse sectional view along line V—V of FIG. 3.

FIGS. 4 and 5 show in detail the two control pins from FIG. 3 in the side-coded depression in the key. As stated, a side-coded depression can only be identified with respect to a normal depression by very precise measurement, because the shape scarcely differs. Only the width of the depression varies by a few tenths of a millimeter, which is not readily visible to the naked eye. FIG. 4 shows a control pin K in its corresponding depression in the key S. The exemplified coding could be ($0_2$;$T_2$;$B_1$), i.e. 3 parameters on the same control pin and whereof there can be one or more in a lock cylinder and with respect to which the associated key can have a corresponding number of side-coded depressions. FIG. 5 shows a control pin offering an equivalent copying hurdle and its exemplified coding could be ($0_1$;$T_o$;$B_2$). The depth coding is related to the shear line SL or to the contact faces so that the offset remains concealed as a possible reference. For both control pins of FIGS. 4 and 5 the side coding zone is identified F, FIG. 2 showing it in hatched form and in it the two-dimensional code is obtained.

Figure 6:
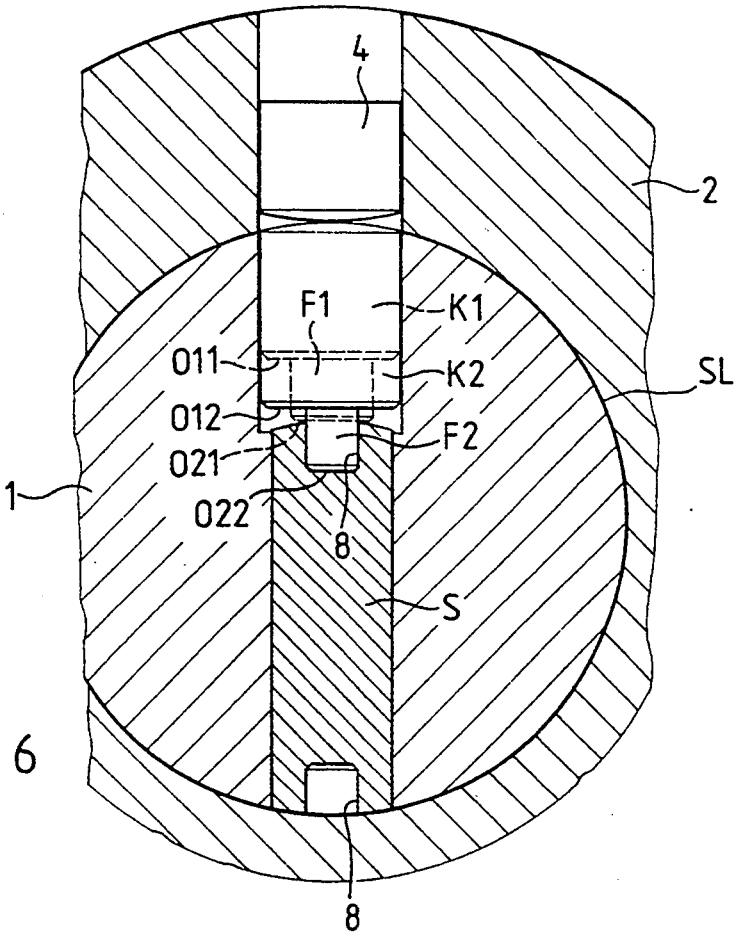
FIG. 6 is a transverse sectional view of a lock and key with tumbler pins showing the use of side coding, in which two tumbler pins are shown, whereof one does and the other does not control on the depression sides.
Figure 7A:
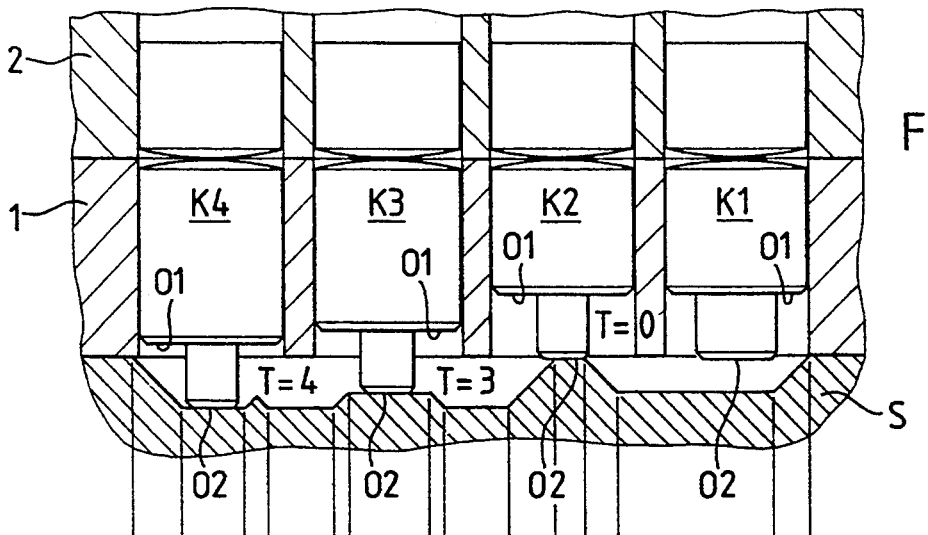
FIGS. 7A and 7B are diagrams of tumbler pin positions showing arrangements based on FIG. 3 wherein tumbler pins controlling on depression sides are used together with those which do not control on the sides of the depression shown.
Figure 7B:
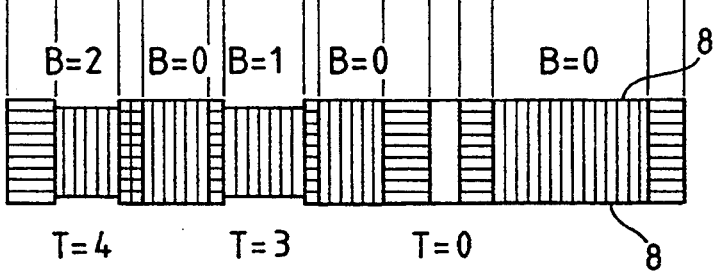

FIGS. 6, 7A and 7B show an embodiment which, functioning in the reverse manner, uses a tumbler pin for controlling "illegal" sides. The way in which this is achieved will be explained hereinafter relative to FIGS. 8 and 10.

FIG. 6 partly shows a rotor 1 located in a stator 2. In the key channel of the rotor is shown a key S with two side-coded narrow side depressions (bottom and top) and their sides 8. It is again pointed out that the side-coded depressions can also be located on the key wide side and there can be one or more of these together with non-side-coded depressions. Located in the depression is shown a side-coded, controlling tumbler pin K2 with the control part F2 and the contact faces 012, 022. A further tumbler pin K1, e.g. behind the pin K2 is also shown and its control part F1 with the contact faces 011,021 cannot be sunk into said depression. The two tumbler pins K1,K2 are so positioned with respect to the shear line SL, that the latter is not freed for an opening turn. For reasons of completeness a counter-tumbler 4 is shown in the stator 2.

The tumbler pin K1 is designed in such a way that its control part F1 is not sunk in to any of the side-coded depressions, because it has a diameter larger than the largest side spacing. This tumbler pin consequently controls the key surface in such a way that every depression blocks the shear line.

Much as in FIG. 3, FIG. 7A shows in longitudinal section through the stator 2, rotor 1 and key S a side-coded row of depressions, in which it is always possible to see a rear side 8. There are four tumbler pins K1 to K4 from right to left. As stated in conjunction with FIG. 6, tumbler pin K1 is a pin which controls the key surface and has a "sinking barrier". The tumbler pins K2 to K4 are side-coded pins with e.g. the following opening code:

K2 (T=0;B=x); K3 (T=3;B=1); K4 (T=4;B=2) in which x=random.

The row of depressions associated with this two-dimensional code is shown in FIG. 7B, which is in plan view. The horizontal hatched parts are inclined sinking and lifting faces with a suitable angle of inclination, while the vertically hatched parts are control faces for the depth Tx. The unhatched surfaces represent the uncut key surface which, as stated, can also be a control face.

It is clear how the additional side coding of a control pin can be used for making copying or forging more difficult. A key with such a code is much more sensitive to undesired copying. Thus, although on an "unauthorized" copying machine a key is always obtained, it will not be usable in the associated cylinder. Although this still constitutes an obstacle for the lawful owner of a key to be copied, it serves for his protection, in much the same way as the protective measures in connection with money circulation, where the lawful user cannot so easily obtain his money.

Figure 8:
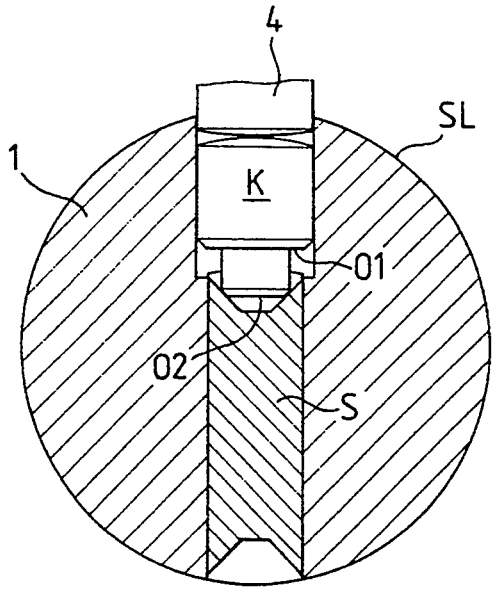
FIG. 8 is a transverse sectional view of a lock rotor with a "poor" key copy in conjunction with a tumbler pin controlling on the depression sides.
Figure 9:
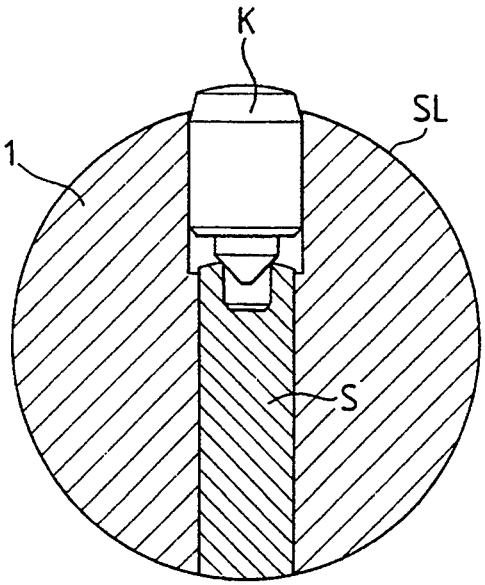
FIG. 9 is a transverse sectional view of a lock rotor with a conventional tumbler pin inserted in a side-coded depression.
Figure 10A:
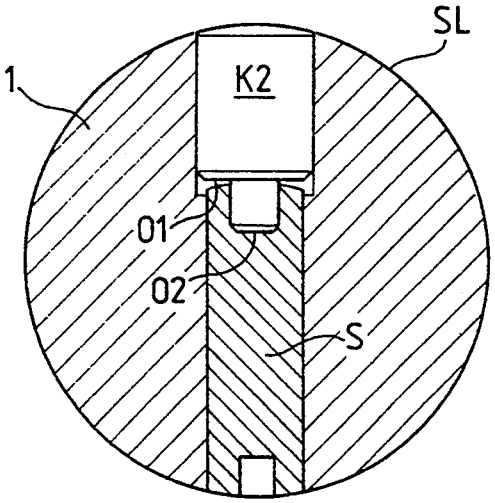
FIGS. 10A and 10B are transverse sectional views of lock rotors showing a control pin inserted in the side-coded depression and another such pin which is not inserted and serves as a sinking barrier.
Figure 10B:
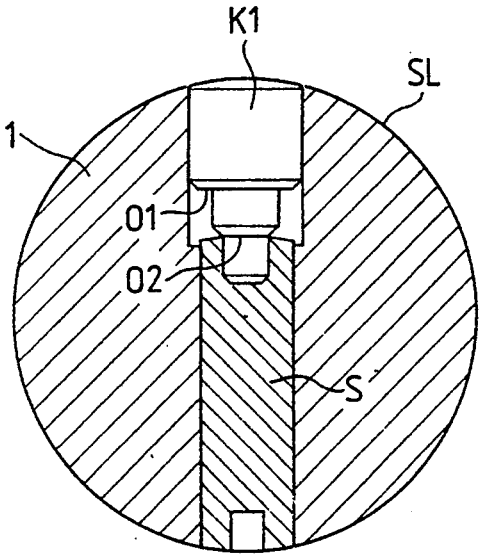
Figure 11:
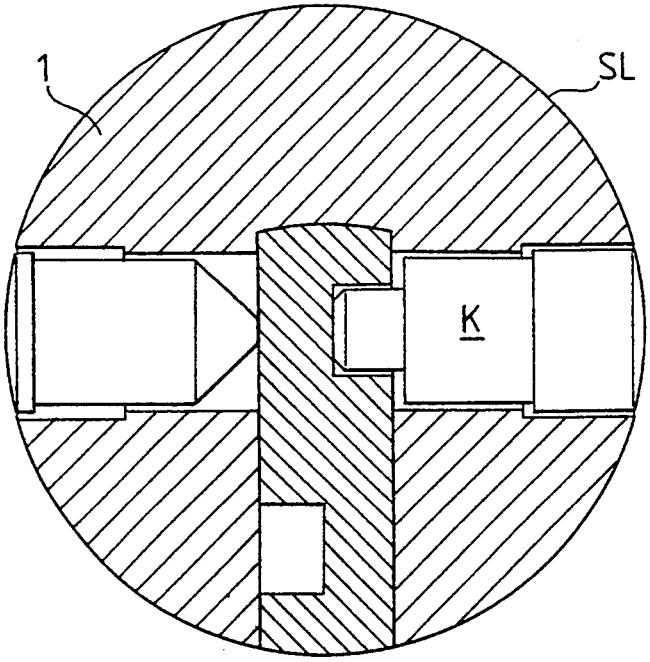
FIG. 11 is a transverse sectional view of the rotor of a first lock cylinder with two tumbler rows and an inserted key, as well as a control pin on the wide side, which cooperates with control faces of the key.
Figure 12:
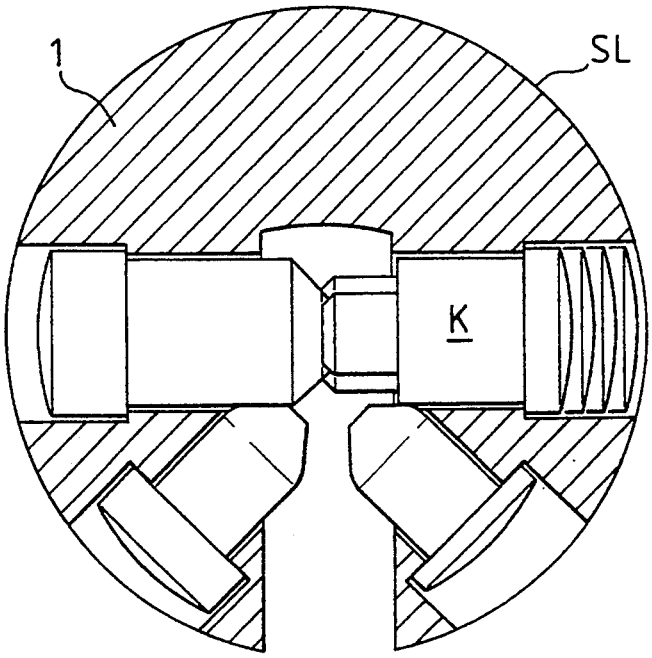
FIG. 12 in cross-section a second lock cylinder with four tumbler rows with the key omitted, as well as a control pin on the wide side which would cooperate with the control faces of an inserted key.

Certain of the obstacles created with this measure are shown in FIGS. 8 to 10, which all show a lock cylinder rotor with a key channel and a key with a narrow side depression and in interplay with a tumbler pin. Naturally the same also applies for a wide side depression and a correspondingly associated tumbler pin, as shown in FIGS. 11 and 12.

FIG. 8 shows a depression produced with a conventional copying milling cutter while ignoring the side condition with a control pin sunk therein and which naturally keeps the shear line blocked. The shear line would also be kept blocked by a tumbler pin with the "sinking barrier" controlling on the key surface.

FIG. 9 shows the effect when a normal tumbler pin is guided over a side-coded depression, namely the shear line remains blocked. FIGS. 10A and 10B in each case show a side-coded depression, which can bring into the opening position a side-coded tumbler pin (FIG. 10A) or a tumbler pin controlling on the key surface (FIG. 10B). It is possible to see the double protective action inherent in this solution. If, for example, a conventional depression is milled, as is shown in FIG. 8 and which has a depth which would bring the side-coded tumbler pin into the correct depth position, a tumbler pin with a sinking barrier cooperating with the same depression, i.e. a key surface-controlling tumbler pin, would prevent an opening of the shear line. The additional security obtained when using side coding and/or side following of side-coded and non-side-coded tumbler pins in conjunction with the depressions in the key is readily apparent. If only a few tumbler pins are constructed with the corresponding depressions in the key in accordance with the proposed measure, then forging can result in copying a few depressions, while the side-coded depressions are given an incorrect form (e.g. FIG. 8), in which it is not possible to either place the side-coded tumblers, or the surface-controlling tumblers with the sinking barrier in such a way as to free the shear line.

A key with a depression, which can correspond with the control pin in the lock cylinder, has two sides 8 with the desired spacing and between which a side-controlling tumbler pin sinks and can then be lifted out again, (cf. also FIGS. 3 to 5) or on which is placed a surface-controlling tumbler pin (control pin) with a sinking barrier. The depressions can be produced by the milling process of the present Applicant described in U.S. Pat. No. 4,289,002. Depressions having such sides can be manufactured extremely accurately by the process known as the continuous path milling process. In addition, no problems are encountered in producing a sequence of depressions, as shown in exemplified manner in FIG. 7A.

A lock cylinder with key, having the proposed constructional feature is more secure against key forging by copying milling than was hitherto the case. Even if a key forger can establish that there is a side coding and has already located the depressions in question, he or she must then be able to reset and adjust his copying milling equipment and in certain circumstances this may be necessary two or three times. Until this has been achieved, he will in all probability have already incorrectly drilled one or more key blanks which cannot be readily obtained if they are provided with control faces for the control pin or pins. It is to be assumed that his interest in forging further such keys will decrease, so that the proposed technical measure in practice achieves the objective of setting up an effective barrier to forging.

A further security element is constituted by the relationship between the control pin and the control faces, which must in any case be present in the key blank, i.e. form a component of the latter, and are not subsequently fitted and on which equally precise demands are made during blank manufacture. Thus, the manufacturing process for a key is subdivided into two completely separate operations, although they only cooperate with a single constructional measure, namely the construction of a control pin. This control face/key blank relationship will now be discussed relative to FIGS. 11 to 14.

FIGS. 11 and 12 each show a section through the lock cylinder with different tumbler means. FIG. 11 shows a cylinder with two tumbler rows and FIG. 12 a cylinder with four tumbler rows. Both lock cylinders have a control pin. In the drawing they are positioned on the right-hand side and are designated K. A key is inserted into one of the key channels and has a hole pattern performing the locking coding function and whose blank was provided with the not shown control faces. The tumbler pin is conditioned in such a way that it reacts to the control faces and the locking code (combination) and due to the control faces can only read said code under specific conditions. In the case of unmatching or non-existing control faces it blocks the cylinder or prevents the insertion of the key or a blank without control faces. This effect of the control faces and certain design examples will be explained relative to FIGS. 13 to 17.

FIG. 13A shows a key blank R for a reversing key and FIGS. 13B, 13C and 13D show parts thereof, which is constructed in such a way that the control faces SF located on the key shank tip run into the key blade over which extends the control face for the specific control pin K according to FIGS. 11 and 12. In the case of a reversing key the other control face cannot be seen from above. The arrangement of additional control faces $SF_X$ is shown in FIGS. 14 to 16, which only show the portion of the key blank having the control faces.

FIG. 13B considers the tip of the blank with the wide side 0, the narrow side F (side) and the key tip S. At the front end is provided a sloping control face SF, which passes into the control face $SF_o$, if the flat side 0 has a control function or, with a slightly different inclination, into the control face $SF_F$, if the narrow side F (side) has the control function. When the key is to be a reversing key, said control faces are symmetrical, which is indicated by the arrow SF. The control faces are naturally not only usable on a single reversing key. FIG. 13C shows a section B—B through the blank according to FIG. 13B, in which it is possible to see a code depression C with a depression side c. A central bisecting plane P is also shown in FIG. 13C, this plane being intersected by surface SF.

FIG. 13D shows the control faces of said embodiment in perspective view. The center line of the key blade is represented by the dash-dot line R. A control face $SF_a$ with a side face $SF_b$ passes into a control face $SF_0$, into which projects the side c of a tumbler depression C of a locking code or combination. If the control curve of the surface $SF_a$ at point a is too high in the direction of the key tip S, then the key cannot be inserted. However, if it is too low the function on the opposite side (reversing key) is disturbed or blocked. Any attempt to produce on a false blank the control face with the milling cutter for the combination or with a coding milling cutter would make the side $SF_b$ too narrow, i.e. it approaches the center line M of a depression C, which is part of the lock/key combination, along which the ends of pins pass as the key is inserted, the depression C having sides c. Consequently, key insertion is blocked by the control pin K1, as shown in FIG. 7A, because the slope outside the control curve of face $SF_a$ is too steep. The control pin would drop into the blocked position if the combination milling was too wide.

FIGS. 14A and 14B show a further example of control faces of a key blank. The control curve or surface SF is shown in the form of a control track $SF/SF_N$ as a slot of width n, in which the side walls serve as control faces. Unlike in the case of the extension of the control faces in FIG. 13, it is narrower than the combination milling and deeper than the combination positions (positions of the key code depressions), i.e. the code depressions are penetrated by the control face slots. Said control face functions in conjunction with a control pin K1 with a diameter somewhat smaller than n, as shown as a tumbler in FIG. 2. The control track or slot with the control faces is shown in perspective in FIG. 14C. However, the proportions are exaggerated somewhat. In actual fact it is only a narrow slot passing centrally through the key code depressions. Part of the bottom is visible from the represented perspectives. The key blank has a slot dimensioned in such a way that the key code is milled via the same. In the section of FIG. 14B it is shown how the control face slot extends over the key blank. A tumbler Z with the control pin K1 is raised at $Z_f$ at the key inlet and then enters the code depression C. The control pin K1 is raised with it and enters the control face slot. The control pin K1 does not reach the bottom of the control face slot in the code depression C. The control face slot is so deep that even in the deepest code depression the control pin does not touch the bottom. This means that only the slot width is decisive and the control pin senses the slot side as control face $SF_N$. The slot width is dimensioned in such a way that the code track is at least partly destroyed by a widening for the purpose of getting around the security element. It is also possible to see that the control faces function completely independently of the key code and are not dependent thereon. Thus, said control faces are an element of the blank and not of the locking code.

If there is no such slot-like control face, or it is too narrow or inadequately deep, the key cannot be inserted or the control pin prevents the combination being sensed at the correct height, namely on side $0_2$ of FIG. 2. If the control track is too wide, it physically destroys the combination or coding plane, i.e. said plane cannot be used or produced. A too deep control track can disturb the function on the opposite side or prevent insertion of the key due to the blocking of the tumblers there.

FIGS. 15A and 15B show a variant derived from the embodiment of FIGS. 14A and 14B, in which a control pin K1 senses the control face SF and then moves along the slot-like control faces $SF_N$. An additional control face KF on the front part of the blank shank serves to prevent insertion of a blank or key when the control pin is missing in the cylinder. This control face is formed by the side KF of a recess having the diameter of a tumbler pin, said recess e.g. being two depth steps deep. The control track $SF_N$ or the slot with the control faces and the control face KF is shown in perspective in FIG. 15C. On inserting the key into the key channel, a tumbler without a control pin will abut against the control face KF. If there is a control pin, the tumbler is raised above the control face KF and the control pin slides into the slot, where it senses the control faces $SF_N$, as shown in conjunction with FIG. 14C.

FIGS. 16A,16B and 16C show a further example of control faces on a key blank. A combination of control curves or surfaces according to FIGS. 14 and 15 give further new security features in interplay with the control face or faces and the control pin or pins, e.g. the control track SF has a slope, i.e. rises and/or falls again, e.g. an additional control side is at an angle of 90° to the inlet, e.g. two control pins simultaneously sense the control faces, both simultaneously having to fulfil a condition, or e.g. the control pin K1 initially runs on the plane $0_2$ and then on plane $0_1$ in the combination area.

In addition to the functional conditions of these embodiments if the narrow control track is continuously milled, the key can no longer be inserted, because the control side rises and the function of the control side can also be built up in reverse manner, so that key removal can be blocked in the case of an incorrectly produced control curve.

In FIG. 16C the control curve SF has a sloping bottom face, which rises and/or falls, the slope of at least two control pins K1 being monitored or controlled. In addition to the functional conditions of these embodiments, if the control curve is not inclined or is incorrectly inclined or not present, the control pin or pins or the counter-tumblers will lock, because they are not in the shear line SL. This is shown in FIGS. 16B and 16C. FIG. 16B shows a control face slot with the control faces SF passing through two code depressions $C_1$ and $C_2$. The control pins K1 sense the control faces $SF_N$, but not the control face SF. If the condition exists that both control pins must simultaneously sense the control face SF, in order to free the shear line, it can be seen that in FIG. 16B neither of the control pins fulfils this condition. The tumbler pins Z are correctly in the code depressions, but the pin K1 closer to the key tip is too deep and consequently the shear line is not free. Thus, the key blank of FIG. 16B is not the correct one. The correct blank for the shown pair of control pins is visible in FIG. 16C, where there is a control face SF rising against the key tip and which keeps the control pin K1, in the vicinity of code depression $C_1$, in the correct position. It is not the code depression which unblocks the shear line, but the control pin K1 assuming the correct position on the control face. the other control pin K1 in the vicinity of the code depression $C_2$ senses the control face $SF_N$. This condition increases security by a key blank, which must be used in conjunction with the correct locking code in order to be able to open the cylinder. Knowing the locking code is not in itself sufficient for producing a correctly operating key because the correct key blank is also required. The control track $SF_N$ or the slot with the control faces and the sloping control face SF are shown in perspective form in FIG. 16D. It is possible to see the sloping control face SF, which is sensed by one of the two control pins K1. The interplay between the two control pins was discussed hereinbefore. It is possible to see that the function of the control face and the control pin is a function pair, which is not dependent on the locking code or its combination and instead constitutes an independent security element. The key blank together with the lock cylinder forms a security element, in the same way as the lock cylinder and the key. In addition, the two security elements cylinder/key relative to the locking code and cylinder/-blank relative to the control faces can be functionally interlinked, so that only both together allow opening to take place. If the correct blank is not used in the production of a key, the cylinder cannot be opened by a key, even if it has the correct locking code. For certain of the indicated functions, this cannot even occur if the key can be completely inserted in the cylinder. It is very difficult in the embodiments according to FIGS. 13 and 14 and impossible in the embodiments according to FIGS. 15 and 16 to establish the necessary key blank by viewing the key channel or measuring the latter, so as to allow copying thereof. Thus, it is not a question of a profile, but of the action of control faces on a key blank in conjunction with the control pins in the lock cylinder.

I claim:

1. A lock and key blank comprising the combination of a lock having a stator and a rotor with a generally rectangular slot to receive the blade of a matching key blank, said slot having an open end into which said key blank is intended to be inserted, said rotor having a blank control pin protruding into said slot to prevent full insertion into said slot of any key blank not intended for use with said lock, said blank control pin having a contact surface, said stator and rotor having a shearline and combination tumbler pins selected to clear said shearline only when a properly coded key for said lock is fully inserted in said slot, said blank control pin being independent of the presence or absence of any combination tumbler pins in said lock and not participating in said combination;

a key blank having a generally rectangular blade shaped and dimensioned to enter said slot;

first means at a tip end of said blade defining a beveled surface inclined relative to wide sides and intersecting a central bisecting plane of said blade for contacting and displacing combination tumbler pins in lock;

second means at said tip end of said blade defining a blank control surface inclined relative to said beveled surface and to said wide sides and intersecting said beveled surface, said blank control surface being independent of any coding recesses formed on said key blank to cooperate with combination tumbler pins in said lock, said blank control pin being dimensioned and positioned to engage and prevent full insertion of any key blank not having said blank control surface, said blank control surface being operative to engage said contact surface of said blank control pin and radially displace said blank control pin to permit full insertion of said key blank into said slot, the combination of said blank control pin and blank control surface thereby forming an admission control for keys and key blanks into said lock.

2. A lock and key blank according to claim 1 wherein said blank control surface has a first surface portion facing said blank control pin and a second surface portion facing transversely of said blank control pin, said first and second portions concurrently contacting said blank control pin to displace said blank control pin radially relative to said slot as said key blank is inserted.

3. A lock and key blank according to claim 2 wherein said blade has two said wide sides, two narrow edges, said tip end and a handle end, and said central bisecting plane substantially parallel with said wide sides, said wide sides being generally parallel with each other.

4. A lock and key blank according to claim 3 wherein said contact surface of said blank control pin has a width greater than any coding depression in said key blank whereby said blank control pin contacts only a wide side of said blade and is therefore independent of any coding on said blade.

5. A lock and key blank according to claim 4 wherein said blade is of uniform rectangular cross-section throughout its length.

6. A lock and key blank according to claim 1 which is formed as a reversing key blank and which has symmetrical blank control surfaces on opposite sides of said central bisecting plane at said blade tip end.

7. A lock and key blank according to claim 1 and further comprising a second blank control surface extending along said blade from said tip end.

8. A lock and key blank according to claim 7 wherein said blank control pin includes a control pin extension, said second blank control surface comprises means defining a groove extending substantially parallel with a longitudinal axis of said blade, said groove having a width smaller than a predetermined width of said contact surface selected to admit only said control pin extension.

9. A lock and key blank according to claim 8 which is formed as a reversing key blank and which has symmetrical blank control surfaces on opposite sides of said blade.

* * * * *